US010385531B2

(12) United States Patent
Suver

(10) Patent No.: US 10,385,531 B2
(45) Date of Patent: Aug. 20, 2019

(54) SPLIT FLIGHT PILE SYSTEMS AND METHODS

(71) Applicant: American Piledriving Equipment, Inc., Kent, WA (US)

(72) Inventor: Paul Suver, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 15/285,326

(22) Filed: Oct. 4, 2016

(65) Prior Publication Data

US 2017/0101759 A1 Apr. 13, 2017

Related U.S. Application Data

(60) Provisional application No. 62/239,692, filed on Oct. 9, 2015.

(51) Int. Cl.

| | |
|---|---|
| ***E02D 5/56*** | (2006.01) |
| ***E02D 7/22*** | (2006.01) |
| ***E02D 7/28*** | (2006.01) |
| ***E02D 7/06*** | (2006.01) |
| ***E02D 7/26*** | (2006.01) |
| ***E02D 27/12*** | (2006.01) |
| ***E02D 27/50*** | (2006.01) |

(52) U.S. Cl.

CPC ..... *E02D 7/28* (2013.01); *E02D 5/56* (2013.01); *E02D 7/06* (2013.01); *E02D 7/22* (2013.01); *E02D 7/26* (2013.01); *E02D 27/12* (2013.01); *E02D 27/50* (2013.01)

(58) Field of Classification Search

CPC combination set(s) only.
See application file for complete search history.

(56) References Cited

U.S. PATENT DOCUMENTS

| | | | |
|---|---|---|---|
| 500,780 | A | 7/1893 | Simon |
| 910,421 | A | 1/1909 | Schlueter |
| 999,334 | A | 8/1911 | Pearson |

(Continued)

FOREIGN PATENT DOCUMENTS

| | | | |
|---|---|---|---|
| CA | 2394894 | * | 2/2002 |
| CA | 2942801 | A1 | 10/2015 |

(Continued)

OTHER PUBLICATIONS

USPTO, "Non-Final Office Action, U.S. Appl. No. 15/372,196," dated Oct. 4, 2017, 23 pages.

(Continued)

*Primary Examiner* — Sean D Andrish
(74) *Attorney, Agent, or Firm* — Michael R. Schacht; Schacht Law Office, Inc.

(57) ABSTRACT

A pile assembly to be driven into the ground comprises an elongate member, a drive member, and a plurality of flight members. The drive member is supported by the elongate member to facilitate axial rotation of the elongate member. The plurality of flight members is supported by the elongate member. Axial rotation of the elongate member causes the plurality of flight members to auger the elongate member into the ground. The flight members are arranged to balance the loads on the elongate member as the elongate member is driven into the ground.

9 Claims, 3 Drawing Sheets

(56) References Cited

U.S. PATENT DOCUMENTS

| | | | | |
|---|---|---|---|---|
| 1,684,816 | A | 9/1928 | Arden | |
| 2,101,285 | A | 12/1937 | Stevens | |
| 2,128,428 | A | 8/1938 | Murray, Jr. | |
| 2,232,845 | A | 2/1941 | Fieroh | |
| 3,059,436 | A | 10/1962 | Hermann, Jr. | |
| 3,175,630 | A | 3/1965 | Hein et al. | |
| 3,411,305 | A | 11/1968 | Cella | |
| 3,999,392 | A | 12/1976 | Fukushima et al. | |
| 4,297,056 | A | 10/1981 | Nottingham | |
| 4,351,624 | A | 9/1982 | Barber | |
| 4,519,729 | A | 5/1985 | Clarke et al. | |
| 4,632,602 | A | 12/1986 | Hovnanian | |
| 4,650,372 | A * | 3/1987 | Gorrell | E02D 5/56 405/232 |
| 4,768,900 | A | 9/1988 | Burland | |
| 5,088,565 | A | 2/1992 | Evarts | |
| 5,106,233 | A | 4/1992 | Breaux | |
| 5,117,925 | A | 6/1992 | White | |
| 5,240,348 | A | 8/1993 | Breaux | |
| 5,244,316 | A | 9/1993 | Wright et al. | |
| 5,263,544 | A | 11/1993 | White | |
| 5,355,964 | A | 10/1994 | White | |
| 5,388,931 | A | 2/1995 | Carlson | |
| 5,515,655 | A | 5/1996 | Hoffmann | |
| 5,529,132 | A | 6/1996 | Evarts | |
| 5,544,979 | A | 8/1996 | White | |
| 5,609,380 | A | 3/1997 | White | |
| 5,653,556 | A | 8/1997 | White | |
| 5,794,716 | A | 8/1998 | White | |
| 6,039,508 | A | 3/2000 | White | |
| 6,394,704 | B1 * | 5/2002 | Saeki | E02D 5/56 405/231 |
| 6,427,402 | B1 | 8/2002 | White | |
| 6,431,795 | B2 | 8/2002 | White | |
| 6,442,906 | B1 | 9/2002 | Hwang | |
| 6,447,036 | B1 | 9/2002 | White | |
| 6,543,966 | B2 | 4/2003 | White | |
| 6,557,647 | B2 | 5/2003 | White | |
| 6,641,323 | B2 | 11/2003 | Ronsheim | |
| 6,648,556 | B1 | 11/2003 | White | |
| 6,672,805 | B1 | 1/2004 | White | |
| 6,732,483 | B1 | 5/2004 | White | |
| 6,736,218 | B1 | 5/2004 | White | |
| 6,896,448 | B1 | 5/2005 | White | |
| 6,908,262 | B1 | 6/2005 | White | |
| 6,988,564 | B2 | 1/2006 | White | |
| 7,168,890 | B1 | 1/2007 | Evarts | |
| 7,392,855 | B1 | 7/2008 | White | |
| 7,694,747 | B1 | 4/2010 | White | |
| 7,708,499 | B1 | 5/2010 | Evarts et al. | |
| 7,824,132 | B1 | 11/2010 | White | |
| 7,854,571 | B1 | 12/2010 | Evarts | |
| 7,914,236 | B2 | 3/2011 | Neville | |
| 7,950,877 | B2 | 5/2011 | Evarts | |
| 8,070,391 | B2 | 12/2011 | White | |
| 8,181,713 | B2 | 5/2012 | White | |
| 8,186,452 | B1 | 5/2012 | White et al. | |
| 8,434,969 | B2 | 5/2013 | White | |
| 8,496,072 | B2 | 7/2013 | White | |
| 8,763,719 | B2 | 7/2014 | White | |
| 8,769,893 | B1 | 7/2014 | Gill et al. | |
| 9,249,551 | B1 | 2/2016 | White | |
| 9,255,375 | B2 | 2/2016 | Yingling et al. | |
| 9,556,581 | B2 | 1/2017 | Hale et al. | |
| 9,556,621 | B2 | 1/2017 | Pelc et al. | |
| 9,631,335 | B2 | 4/2017 | Reusing et al. | |
| 9,957,684 | B2 | 5/2018 | Suver et al. | |
| 2005/0039952 | A1 | 2/2005 | Hill et al. | |
| 2006/0198706 | A1 * | 9/2006 | Neville | E02D 7/22 405/252.1 |
| 2010/0266344 | A1 | 10/2010 | Plotkin et al. | |
| 2010/0303552 | A1 | 12/2010 | Yingling et al. | |
| 2011/0162859 | A1 | 7/2011 | White | |
| 2012/0292062 | A1 | 11/2012 | White | |
| 2013/0149040 | A1 | 6/2013 | Evarts | |
| 2014/0056652 | A1 | 2/2014 | Suver | |
| 2014/0356075 | A1 * | 12/2014 | Hale | E02D 27/16 405/230 |
| 2014/0377011 | A1 | 12/2014 | Yingling et al. | |
| 2015/0016893 | A1 | 1/2015 | Suver et al. | |
| 2016/0356294 | A1 | 12/2016 | Fenwick et al. | |
| 2017/0167102 | A1 | 6/2017 | Suver et al. | |

FOREIGN PATENT DOCUMENTS

| | | | |
|---|---|---|---|
| CN | 102296608 | B | 7/2015 |
| JP | 59228529 | A | 12/1984 |
| JP | 497015 | A | 3/1992 |
| JP | 2005256500 | A | 9/2005 |
| JP | 2005315050 | A | 11/2005 |
| JP | 2006089933 | A | 4/2006 |
| JP | 2006177125 | A | 7/2006 |
| JP | 2006312825 | A | 11/2006 |
| JP | 2009138487 | A | 6/2009 |
| NO | 46428 | | 4/1929 |
| RU | 2109881 | C1 | 4/1998 |
| WO | WO 96/00326 | * | 1/1996 |
| WO | 2012031108 | A1 | 3/2012 |

OTHER PUBLICATIONS

USPTO, "Non-Final Office Action, U.S. Appl. No. 15/174,724," dated Dec. 11, 2018, 18 pages.

* cited by examiner

SPLIT FLIGHT PILE SYSTEMS AND METHODS

RELATED APPLICATIONS

This application, U.S. patent application Ser. No. 15/285,326 filed Oct. 4, 2016 claims benefit of U.S. Provisional Application Ser. No. 62/239,692 filed Oct. 9, 2015, the contents of which are incorporated herein by reference.

TECHNICAL FIELD

The present invention relates to pile systems and methods and, in particular, to pile systems configured to be augered into the ground.

BACKGROUND

Piles are common driven into the ground to provide support for structures. Depending on the nature of the structure and the nature of ground where structure is to be built, the pile can be configured in a number of different shapes and sizes and can be manufactured of a variety of different materials.

A common pile type is made of cylindrical pipe. Cylindrical pipe piles are relatively in expensive and are commonly driven into the ground using a combination of static and vibrational forces. Certain pipe piles are provided with a drive bit to allow the cylindrical pipe pile to be driven into the ground using axial rotation.

The need exists for improved pipe piles that facilitate the insertion of the pile into the ground.

SUMMARY

The present invention may be embodied as a pile assembly to be driven into the ground comprises an elongate member, a drive member, and a plurality of flight members. The drive member is supported by the elongate member to facilitate axial rotation of the elongate member. The plurality of flight members is supported by the elongate member. Axial rotation of the elongate member causes the plurality of flight members to auger the elongate member into the ground. The flight members are arranged to balance the loads on the elongate member as the elongate member is driven into the ground.

A pile assembly to be driven into the ground comprises an elongate member, a drive member, and a plurality of flight members. The elongate member is hollow and cylindrical elongate member and defines a drive end portion, a driven end portion, and a shaft portion extending between the drive end portion and the driven end portion. The drive member is arranged on the drive end portion of the elongate member to facilitate axial rotation of the elongate member. The plurality of flight members arranged on the driven end portion of the elongate member. Axial rotation of the elongate member causes the plurality of flight members to auger the elongate member into the ground. The flight members are arranged to balance the loads on the elongate member as the elongate member is driven into the ground.

The present invention may also be embodied as a method of driving a pile assembly into the ground comprising the following steps. An elongate member is provided. A drive member is supported on the elongate member. A plurality of flight members is supported on the elongate member. The drive member is engaged to axially rotate the elongate member such that the plurality of flight members auger the elongate member into the ground. The flight members are arranged to balance the loads on the elongate member as the elongate member is driven into the ground.

DETAILED DESCRIPTION

Figure 1:
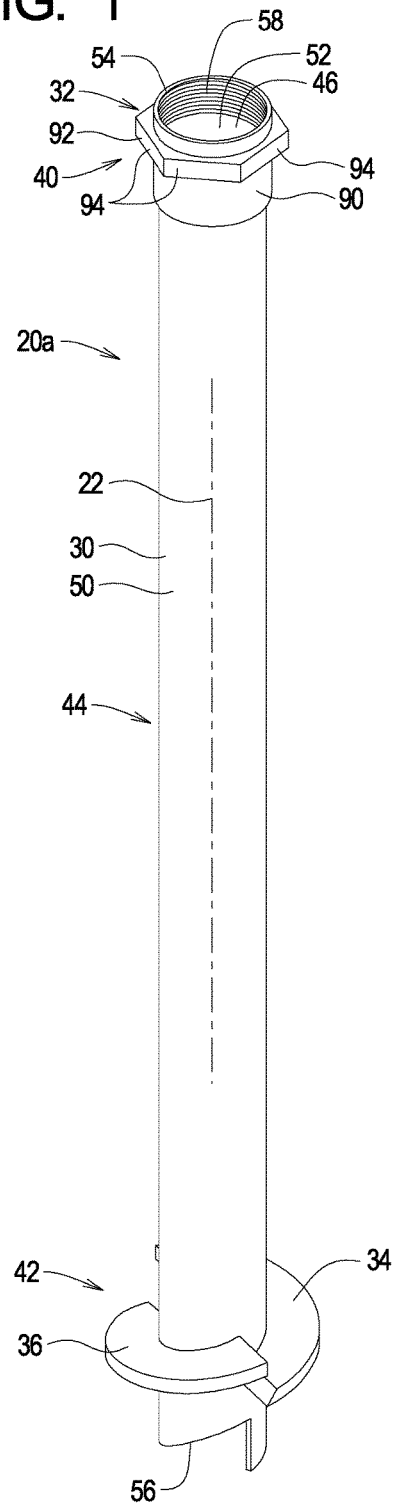
FIG. 1 is a perspective view of a first example pile assembly of the present invention.

Referring initially to FIGS. 1-6 of the drawing, depicted therein is a first example pile assembly 20*a* constructed in accordance with, and embodying, the principles of the present invention. The first example pile assembly 20*a* defines a pile axis 22 and is driven into the ground 24 (FIG. 2) with the pile axis 22 at a desired orientation.

Figure 2:
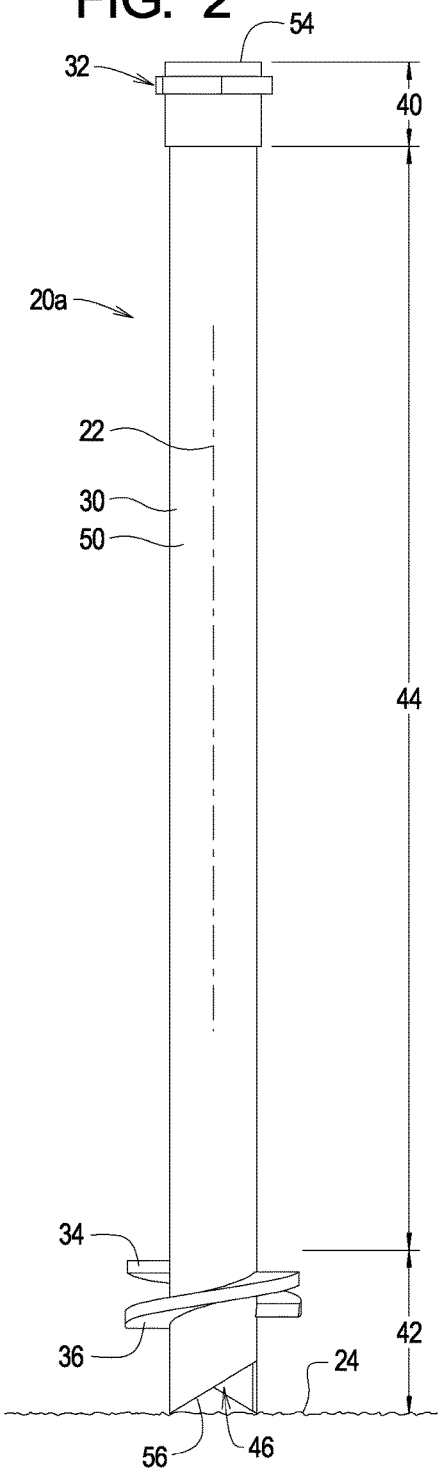
FIG. 2 is a first side elevation view of the first example pile assembly.

The first example pile assembly 20*a* comprises an elongate member 30, a drive member 32, and first and second flight members 34 and 36. As shown in FIG. 2, the drive member 32 is secured to or integrally formed with a drive end portion 40 of the elongate member 30, while the first and second flight members 34 and 36 are secured to or integrally formed with a driven end portion 42 of the elongate member 30. A shaft portion 44 of the elongate member 30 extends between the drive end portion 40 and the driven end portion 42. The example elongate member 30 is hollow and defines a central chamber 46.

More specifically, the example elongate member 30 is a cylindrical hollow member defining an outer surface 50, an inner surface 52, a drive end surface 54, and a driven end surface 56. A threaded surface portion 58 of the inner surface 52 is formed at the drive end portion 40 of the elongate member 30. The example drive end surface 54 is circular as best shown in FIG. 1. The example driven end surface 56 comprises a first portion 56*a*, a second portion 56*b*, a third portion 56*c*, and a fourth portion 56*d*. As perhaps best shown by a comparison of FIGS. 2-6, in the example elongate member 30 the first and third portions 56*a* and 56*c* of the driven end surface 56 are laterally spaced from and substantially parallel to the pile axis 22. A comparison of FIGS. 2-6 further shows that, in the example elongate member 30, the second and fourth portions 56*b* and 56*d* of the driven end surface 56 are laterally spaced from and angled with respect to the pile axis 22.

The intersections of the first and second portions 56*a* and 56*b* of the driven end surface 56 defines a first point 60*a*, while the intersections of the third and fourth portions 56*c* and 56*d* of the driven end surface 56 defines a second point 60*b*. Associated with the first and second points 60*a* and 60*b* are first and second tooth portions 62*a* and 62*b* of the elongate member 30. The tooth portions 62*a* and 62*b* of the elongate member 30 are formed in the driven end portion between the first and second flight members 34 and 36 and the driven end surface 56.

Referring again to FIGS. 2-6, it can be seen that the example first flight member 34 defines a first lead surface 70, a first perimeter surface 72, a first engaging surface 74, a first rear surface 76, and a first trailing surface 78. Similarly, the example second flight member 36 defines a second lead surface 80, a second perimeter surface 82, a second engaging surface 84, a second rear surface 86, and a second trailing surface 88. The first and second flight members 34 and 36 are metal plates that are welded to the outer surface 50 of the elongate member 30.

Referring for a moment back to FIG. 1, it can be seen that the drive member 32 comprises a collar portion 90 and a drive portion 92. The drive portion 92 defines at least one drive surface 94. The example drive portion 92 is a hex drive defining six drive surfaces 94. The drive portion 92 is secured to the collar portion 90 and the collar portion 90 is secured to the drive end portion 40 of the elongate member 30 such that the drive surfaces 94 allow the drive member 32 to be axially rotated about the pile axis 22.

Figure 5:
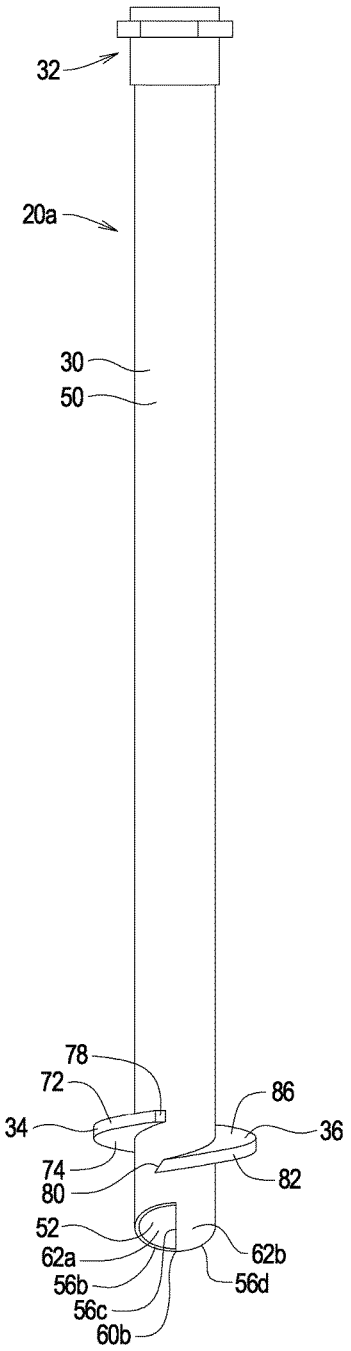
FIG. 5 is a fourth side elevation view of the first example pile assembly rotated 90 degrees from the third side elevation view.
Figure 6:
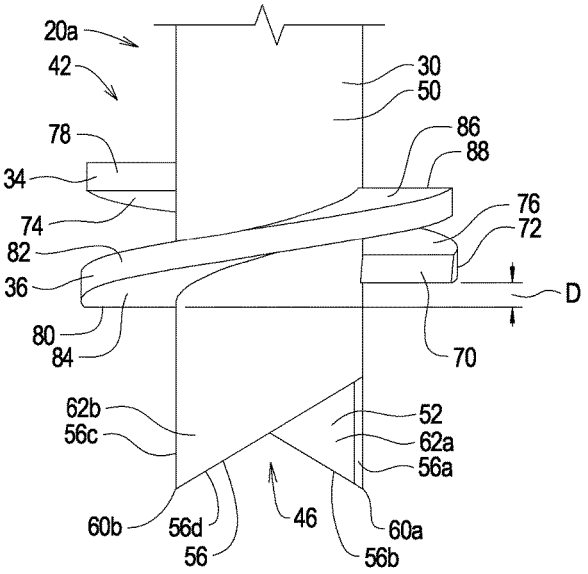
FIG. 6 is a side elevation view of a portion of FIG. 2 illustrating an offset between first and second flight members of the first example pile assembly.

As is apparent from a comparison of FIGS. 2-6, the example first and second flight members 34 and 36 are symmetrically arranged about a longitudinal reference plane (not shown) defined by the pile axis 22. In particular, the example first and second flight members 34 and 36 are identical helical structures and are each arranged entirely on opposite sides of the reference plane. The example flight members 34 and 36 are semi helical or partially helical in that they extend only partly around the circumference of the example cylindrical elongate member 30. In the example pile assembly 20*a*, the example flight members 34 and 36 each extend approximately 180 degrees around the circumference of the example elongate member 30. Further, FIG. 6 illustrates that the example first and second flight members 34 and 36 are offset from each other along the pile axis by a distance D.

The flight members 34 and 36 also need not be identical. Further, the flight members 34 and 36 may each extend less or more than 180 degrees around the circumference of the elongate member 30. Further, while two flight members 34 and 36 are used in the example pile assembly 20*a*, more than two flight members may be used.

Figure 7:
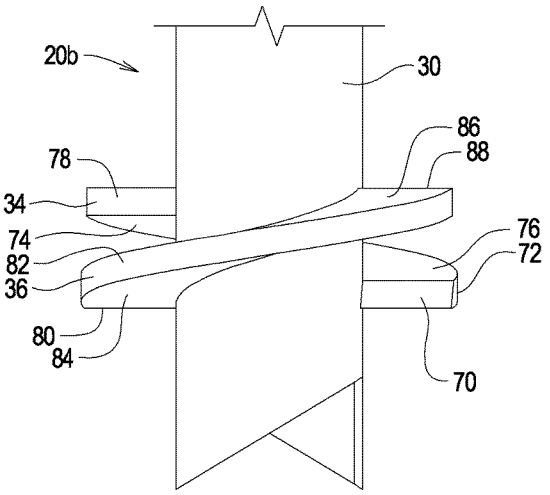
FIG. 7 is a partial, side elevation view of a second example pile assembly having no offset between first and second flight members thereof.

Further, a second example pile assembly 20*b* is shown in FIG. 7. The second example pile system 20*b* is in all most similar to the first example pile assembly 20*a* and will be described herein only to the extent that the two pile assemblies differ. In particular, FIG. 7 illustrates that, in the second example pile system 20*b*, the flight members 34 and 36 are not offset from each other.

Figure 3:
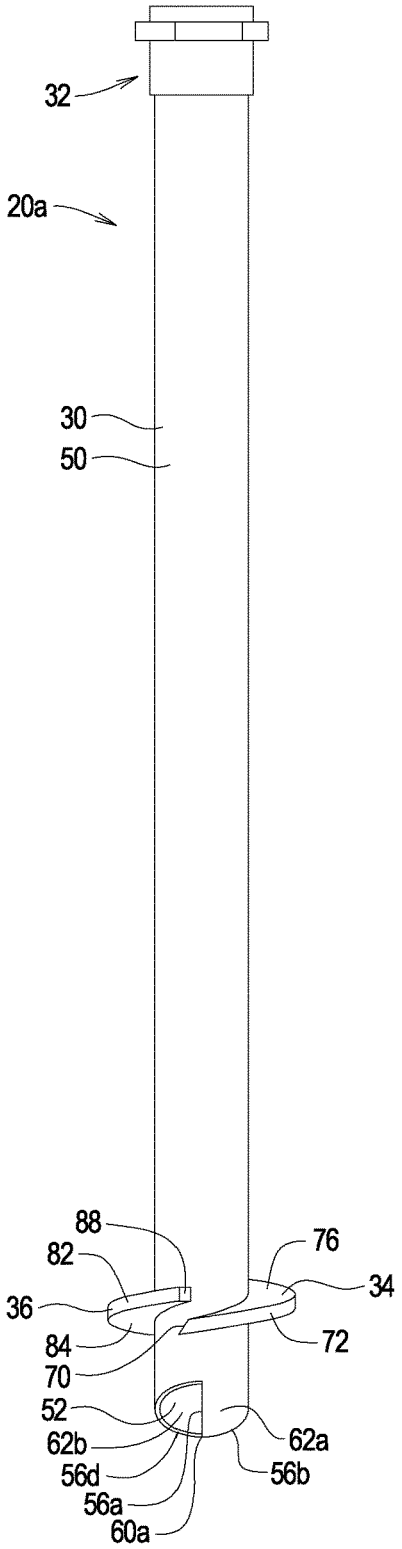
FIG. 3 is a second side elevation view of the first example pile assembly rotated 90 degrees from the first side elevation view.
Figure 4:
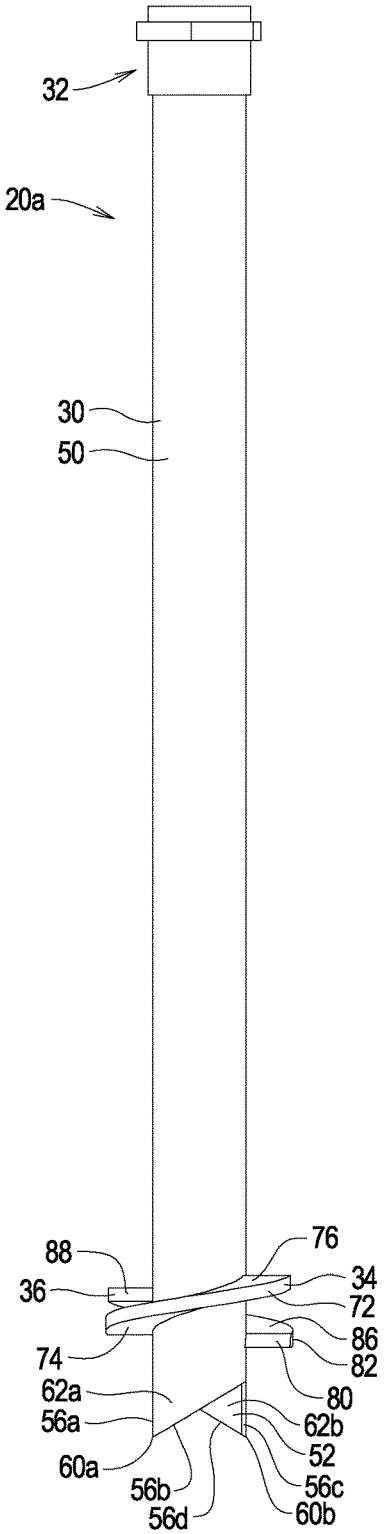
FIG. 4 is a third side elevation view of the first example pile assembly rotated 90 degrees from the second side elevation view.

In use, the pile assembly 20*a* or 20*b* is supported with the driven end portion 42 in contact with the ground 24 and the drive end portion 40 arranged such that the pile axis 22 is at a desired angular relationship with vertical and/or horizontal. The driven end portion 42 is then axially rotated (typically be engaging the drive member 32) such that the tooth portions 62*a* and 62*b* initiate insertion of the pile assembly 20*a* or 20*b* into the ground 24. After a few turns, the first lead surface 70 and then the second lead surface 80 engage the ground 24. Continued axial rotation of the elongate member 30 causes the first and second flight members 34 and 36 to auger the pile assembly 20*a* or 20*b* into the ground 24. FIGS. 3 and 5 illustrate that the lead surfaces 70 and 80 may be angled with respect to the pile axis 22 to enhance the ability of the lead surfaces 70 and 80 to cut into the ground 24.

The use of two or more flight members such as the flight members 34 and 36 balances the loads on the elongate member 30 created by the engagement of the flight members 34 and 36 with the ground 24 as the pile assembly 20*a* or 20*b* is being augered into the ground 24. The desired angular relationship between vertical and/or horizontal is more easily maintained with the balanced forces created by the example first and second flight members 34 and 36. Again, different shapes, numbers, and arrangements of flight members may be used to obtain a balanced force as the pile assembly 20*a* or 20*b* is being augered into the ground 24 until the drive member 32 is at or near a surface of the ground 24.

Optionally, after the pile assembly 20*a* or 20*b* is driven to a point at which the drive member 32 is at or near a surface of the ground 24, an extension pile member (not shown) may be connected to the pile assembly 20*a* or 20*b* to allow further driving of the pile assembly 20*a* or 20*b*. An extension pile member is similar to the pile assembly 20*a* or 20*b* except that the outer surface thereof at the driven end is externally threaded to engage with the threaded surface portion 58. With the external threaded surface of the extension pile member engaged with the threaded surface portion 58, rotation of the extension pile member causes the threaded portions to engage to join the extension pile member to the pile assembly 20*a* or 20*b*. Continued rotation of the extension pile member causes rotation of the pile assembly 20*a* or 20*b* and further drives the pile assembly 20*a* or 20*b* into the ground 24 such that the drive member 32 is below the surface of the ground 24. Additional extension pile members may be used to form a pile string extending a desired target depth.

What is claimed is:

1. A pile assembly to be driven into the ground comprising:

a cylindrical hollow elongate member defining a driven end portion and a pile axis, where the pile axis is aligned with a longitudinal axis of the elongate member, the driven end portion defines a driven end surface, and the driven end surface defines a plurality of first portions angled relative to the pile axis, a plurality of second portions angled relative to the pile axis, and a point defined at an intersection of each of the first and second portions such that a plurality of one tooth portions is integrally formed by the elongate member;

a drive member supported by the elongate member to facilitate axial rotation of the elongate member; and a plurality of flight members each defining a lead surface and a trailing surface, where the lead surfaces are angled with respect to the pile axis; whereby the plurality of flight members are substantially helical and are supported by the driven end portion of the elongate member such that each of the plurality of flight members extends from the driven end portion of the elongate member through a different angular portion, where the different angular portions extend substantially the same distance around the circumference of the elongate member and the different angular portions total approximately 360 degrees, the plurality of flight members are symmetrically supported on the elongate member such that the lead surface of each flight member is at substantially the same angular location as the trailing surface adjacent thereto and the trailing surface of each flight member is at substantially the same angular location as the lead surface adjacent thereto, each of the plurality of flight members is spaced from the driven end surface of the elongate member, and each of the plurality of flight members is spaced from at least one other flight member such that at least one of the plurality of flight members is offset from at least one of the flight members along the pile axis;

axial rotation of the elongate member causes the at least one tooth portion defined by the driven end surface to engage the ground, after the driven end surface engages the ground, the lead surface closest to the tooth portions cuts into the ground, after the lead surface closest to the tooth portions cuts into the ground, another lead surface cuts into the ground, and the plurality of flight members engage the ground to auger the elongate member into the ground; and the flight members engage the ground to balance loads on the elongate member as the elongate member is rotated to auger the elongate member into the ground.

2. A pile assembly as recited in claim 1, in which the plurality of flight members comprises first and second flight members; the first flight member extends around the driven end portion of the elongate member through an angle of approximately 180 degrees; and the second flight member extends around the driven end portion of the elongate member through an angle of approximately 180 degrees.

3. A pile assembly as recited in claim 1, in which:

the first portions of the driven end surface are substantially parallel to the pile axis; and the second portion of the driven end surface are angled relative to the pile axis.

4. A pile assembly to be driven into the ground comprising:

a hollow, cylindrical elongate member defining a pile axis, a drive end portion, a driven end portion, and a shaft portion extending between the drive end portion and the driven end portion, where the pile axis is aligned with a longitudinal axis of the elongate member, and the driven end portion defines a driven end surface that is substantially cylindrical and defines a plurality of first portions angled relative to the pile axis, at bast a plurality of second portions angled relative to the pile axis, and a point defined at an intersection of the first and second portions such that a plurality of tooth portions is integrally formed by the elongate member;

a drive member arranged on the drive end portion of the elongate member to facilitate axial rotation of the elongate member; and a plurality of flight members each defining a lead surface and a trailing surface, where the lead surfaces are angled with respect to the pile axis; whereby the plurality of flight members are substantially helical and are supported by the driven end portion of the elongate member such that each of the plurality of flight members extends around the driven end portion of the elongate member through a different angular portion, where the different angular portions extend substantially the same distance around the circumference of the elongate member and the different angular portions total approximately 360 degrees, the plurality of flight members are symmetrically supported on the elongate member such that the lead surface of each flight member is at substantially the same angular location as the trailing surface adjacent thereto and the trailing surface of each flight member is at substantially the same angular location as the lead surface adjacent thereto, and each of the plurality of flight members is spaced from at least one other flight member such that at least one of the plurality of flight members is offset from at least one of the flight members along the pile axis;

axial rotation of the elongate member causes the at least one tooth portion defined by the driven end surface to engage the ground, and after the driven end surface penetrates the ground, the lead surface closest to the tooth portions cuts into the ground, after the lead surface closest to the tooth portions cuts into the ground, another lead surface cuts into the ground, and the plurality of flight members engage the ground to auger the elongate member into the ground; and the plurality of flight members engage the ground to balance the loads on the elongate member as the elongate member is rotated to auger the elongate member into the ground.

5. A pile assembly as recited in claim 4, in which:

the plurality of flight members comprises first and second flight members;

the first flight member extends around the drive end portion of the elongate member through an angle of approximately 180 degrees; and the second flight member extends around the driven end portion of the elongate member through an angle of approximately 180 degrees.

6. A pile assembly as recited in claim 4, in which:

the first portions of the driven end surface are substantially parallel to the pile axis; and the second portions of the driven end surface are angled relative to the pile axis.

7. A method of driving a pile assembly into the ground comprising the steps of:

providing a cylindrical hollow elongate member defining a driven end portion and a pile axis, where the pile axis is aligned with a longitudinal axis of the elongate member, the driven end portion defines a driven end surface, and the driven end surface defines a plurality of first portions angled relative to the pile axis, portions angled extending at a second angle relative to the pile axis, and a point defined at an intersection of each of the first and second portions such that a plurality of tooth portions is integrally formed by the elongate member;

supporting a drive member on the elongate member;

providing a plurality of substantially helical flight members each defining a lead surface and a trailing surface, where the lead surfaces are angled with respect to the pile axis;

supporting the plurality of flight members on the driven end portion of the elongate member such that each of the plurality of flight members extends around the driven end portion of the elongate member a different angular portion, where the different angular portions extend substantially the same distance around the circumference of the elongate member and the different angular portions total approximately 360 degrees, the plurality of flight members are symmetrically supported on the elongate member such that the lead surface of each flight member is at substantially the same angular location as the trailing surface adjacent thereto and the trailing surface of each flight member is at substantially the same angular location as the lead surface adjacent thereto, each of the plurality of flight members is spaced from the driven end surface of the elongate member, and each of the plurality of flight members is spaced from at least one other flight member such that at least one of the plurality of flight members is offset from at least one of the flight members along the pile axis; and engaging the drive member to axially rotate the elongate member such that the at least one tooth portion defined by the driven end surface to engage the ground, and after the driven end surface engages the ground, the lead surface closest to the tooth portions cuts into the ground, after the lead surface closest to the tooth portions cuts into the ground, another lead surface cuts into the ground, and the plurality of flight members engage the ground to auger the elongate member into the ground; wherein the plurality of flight members engage the ground to balance loads on the elongate member as the elongate member is rotated to auger the elongate member into the ground.

8. A method as recited in claim 7, in which:

the step of providing a plurality of substantially helical flight members comprises the step of providing first and second flight members such that the first flight member extends around the driven end portion of the elongate member through an angle of approximately 180 degrees; and the second flight member extends around the drive end portion of the elongate member through an angle of approximately 180 degrees.

9. A method as recited in claim 7, in which the step of providing the cylindrical hollow elongate member comprises the steps of:

forming the first portions of the driven end surface such that the first portions are substantially parallel to the pile axis; and forming the second portions of the driven end surface such that the second portions are angled relative to the pile axis.

* * * * *